US007121397B2

(12) United States Patent
Yuyama et al.

(10) Patent No.: US 7,121,397 B2
(45) Date of Patent: Oct. 17, 2006

(54) MEDICINE PACKAGE CONVEYING APPARATUS

(75) Inventors: Shoji Yuyama, Toyonaka (JP); Nakaji Takeda, Toyonaka (JP); Wataru Maeyama, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 42 days.

(21) Appl. No.: 10/990,422

(22) Filed: Nov. 18, 2004

(65) Prior Publication Data

US 2005/0121290 A1 Jun. 9, 2005

(30) Foreign Application Priority Data

Nov. 20, 2003 (JP) ..... 2003-391113

(51) Int. Cl.
*B65G 13/00* (2006.01)

(52) U.S. Cl. ..... 193/35 R; 198/624

(58) Field of Classification Search ..... 198/624, 198/626.3, 626.4, 608, 613, 642, 782, 785; 193/35 R, 37, 35 C
See application file for complete search history.

(56) References Cited

U.S. PATENT DOCUMENTS 3,648,553 A * 3/1972 Tuschy et al. ..... 193/35 R
3,720,399 A * 3/1973 Bozeman, Jr. ..... 198/624
4,678,178 A * 7/1987 Akiyama et al. ..... 198/624
5,762,177 A * 6/1998 Baker et al. ..... 193/35 R
6,059,280 A * 5/2000 Yamauchi et al. ..... 193/35 R
6,935,488 B1 * 8/2005 Dow et al. ..... 193/37

FOREIGN PATENT DOCUMENTS

JP 5-132008 5/1993
JP 2538350 7/1996

* cited by examiner

*Primary Examiner*—James R. Bidwell
(74) *Attorney, Agent, or Firm*—Wenderoth, Lind & Ponack, L.L.P.

(57) ABSTRACT

A medicine package conveying apparatus is provided with a conveyor (7) and a roller member (9) to convey a medicine package (100) with a plurality of bags in which medicine is packaged. The roller member (9) is made of elastic material and includes press portions (31) of cylindrical shape which rotate and press both side edges of the medicine package (100) on the conveyor (7) and an escape portion (32) which is positioned between the press portions (31) and is smaller in a diameter than the press portions (31). Thus, the medicine package conveying apparatus can smoothly convey the medicine package.

6 Claims, 10 Drawing Sheets

MEDICINE PACKAGE CONVEYING APPARATUS

BACKGROUND OF THE INVENTION

The present invention relates to a medicine package conveying apparatus for conveying a medicine package in which medicine is packed by a medicine packing apparatus.

Conventionally, a belt-like medicine package in which medicine is packed by a medicine packing apparatus is conveyed by, for example, a conveyance apparatus described below from a lower position to a higher position.

There is known a conveying apparatus in which a pair of fiat belts, which run on a plurality of rollers, is positioned to form a conveyance passage for the medicine package with a predetermined distance and a tension unit is provided so as to adjust the tension acting on the flat belts (for example, see Japanese patent No. 2538350).

There is also a known package discharging, guiding and conveying apparatus in which a package guided into an insert hole by package guiding and traveling means is sandwiched between conveyance belts and conveyed as the conveyance belts are maintained in a strained state by a press roller provided on a tension arm (for example, see Japanese Laid-open Patent Publication No. H05-132008).

In the apparatuses described above, the medicine package is sandwiched between the belts having a constant gap and conveyed. When the medicine package contains a large amount of medicine it can bulk up, and cause the problems of clogging, tearing of the medicine package and so on.

In the case in which a medicine capsule is contained in a package as shown in FIG. 10, the capsule may be packed in a state standing in a direction of thickness of the medicine package so that the package bulks up. This causes a problem in that the medicine package cannot be smoothly conveyed.

SUMMARY OF THE INVENTION

Thus, it is an object of the present invention to provide a medicine package conveying apparatus which can smoothly convey a medicine package.

In one aspect of the present invention, the medicine package conveying apparatus comprises:

a conveyor for conveying a medicine package with a plurality of bags in which medicine is packaged; and a roller member made of elastic material. The roller member comprises press portions of cylindrical shape which rotate and press both side edges of the medicine package on the conveyor and an escape portion which is positioned between the press portions and is smaller in a diameter than the press portions.

According to the above construction, driving of the conveyor allows the medicine package to be conveyed in a state in which the medicine package is sandwiched between the conveyor and the press portions of the roller member. The press portions rotate in conjunction with the drive of the conveyor and also have elasticity. Thus, the medicine package can be conveyed in a stable condition without being damaged. Even if the medicine package bulges in a direction of the thickness of the medicine package as in the case when a capsule contained in the medicine package is standing in the direction of the thickness of the medicine package and when powder contained in the medicine package is biased, the escape portions never prevent the medicine package from being conveyed.

Preferably, the escape portion is formed so as not to interfere with the medicine package to be conveyed. Thus, it is possible to surely eliminate clogging and so on of the medicine package and more smoothly convey the medicine package.

Preferably, the roller member can pivot so that the roller member will be released from the conveyor when the press portions are pushed up by a force of more than a standard value. Thus, excessive load is not applied to the medicine package and therefore it is possible to surely prevent the medicine package from being damaged.

In another aspect of the present invention, the medicine package conveying apparatus comprises:

a conveyor for conveying a medicine package with a plurality of bags in which medicine is packaged; and a roller member comprising a plurality of fin portions having an elasticity. The plurality of fin portions radially extends from a rotation shaft of the roller member so that at least one of the plurality of fin portions presses the medicine package on the conveyor.

According to the above construction, the medicine package is conveyed in a state in which the medicine package is sandwiched between the conveyor and at least one of the fin portions. Even if the medicine package bulges in a direction of the thickness of the medicine package as in the case where a capsule contained in the medicine package is standing in the direction of the thickness of the medicine package and in the case where powder contained in the medicine package is biased, the fin portion will deform so that the medicine package smoothly passes. Thus, the medicine package is never prevented from being conveyed.

Preferably, the roller member further comprises guide portions of cylindrical shape. The guide portions are positioned on both sides of the rotation shaft and come into contact with the conveyor to prevent the fin portion from deforming. Thus, it is possible to prevent the fin portions from deforming more than necessary and make it stable to convey the medicine package by means of the conveyor and the fin portions.

Preferably, the plurality of fin portions are positioned with such a pitch that when a capsule is contained in the medicine package in a state standing in a direction of thickness of the medicine package, the capsule can be laid down. Thus, it is possible to convey the medicine package with the unsuitably contained state of the capsule dissolved.

As the particular conveyor, any type of conveyors such as belt type, chain type, roller type, screw type and so on can be used. In a word, the conveyor may have a construction of a band-like circulation unit for continuously conveying the medicine package.

As the press portion, any kind of elastic material such as sponge, rubber and so on can be used. In this case, the entire roller member may be formed of elastic material. The roller member may be constructed by fixing the press portions made of elastic material on the rotation shaft by means of adhesive or the like.

The press portions have a "cylindrical" shape, though the term of "cylindrical" means a shape having an outer periphery (face or line) that makes it possible to sandwich the medicine package between the outer periphery and the conveyor. Therefore, the "cylindrical" shape includes a disc or the like and may have the outer periphery that is partly cut out.

The shape of the escape portion is not limited and may include a solid cylinder as well as a hollow cylinder. In a word, the escape portion may have such a construction that the interference with the medicine package is reduced or eliminated even if the medicine package bulges in a direction of thickness of the medicine package. In the case that the escape portion partially interferes with the medicine package, it is also possible to make the interfering part of the escape portion elastic and adopt such a fin-like shape that the capsule can be forcedly laid down.

The roller member may be constructed so that the press portion can press both side edges of the medicine package by its own weight.

The medicine package may have a sealed portion on at least one of side edge. In this case, the roller member may be constructed so that the press portion can press the sealed portion. Thus, the interference with the medicine contained in the medicine package can be eliminated.

The standard value of the force exerted on the press portion may be such a value that an excessive load applied to the medicine package does not lead to damage of the medicine package.

According to the present invention, as the medicine package is conveyed by the conveyor and the roller member, comprising the press portions and the escape portion or the in portions, it is possible to smoothly convey a medicine package without causing clogging or the like of the medicine package.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
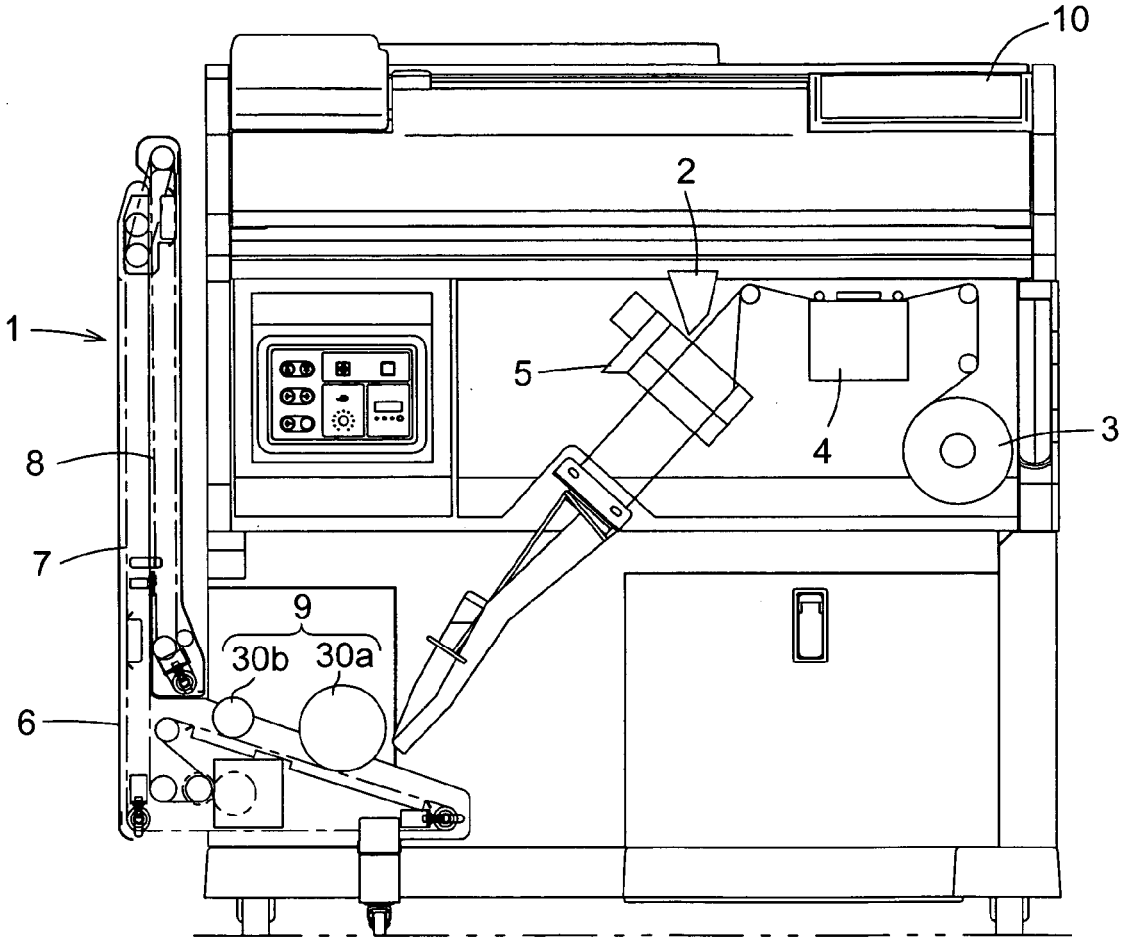
FIG. 1 is a front view of a medicine packing apparatus according to one embodiment.
Figure 2:
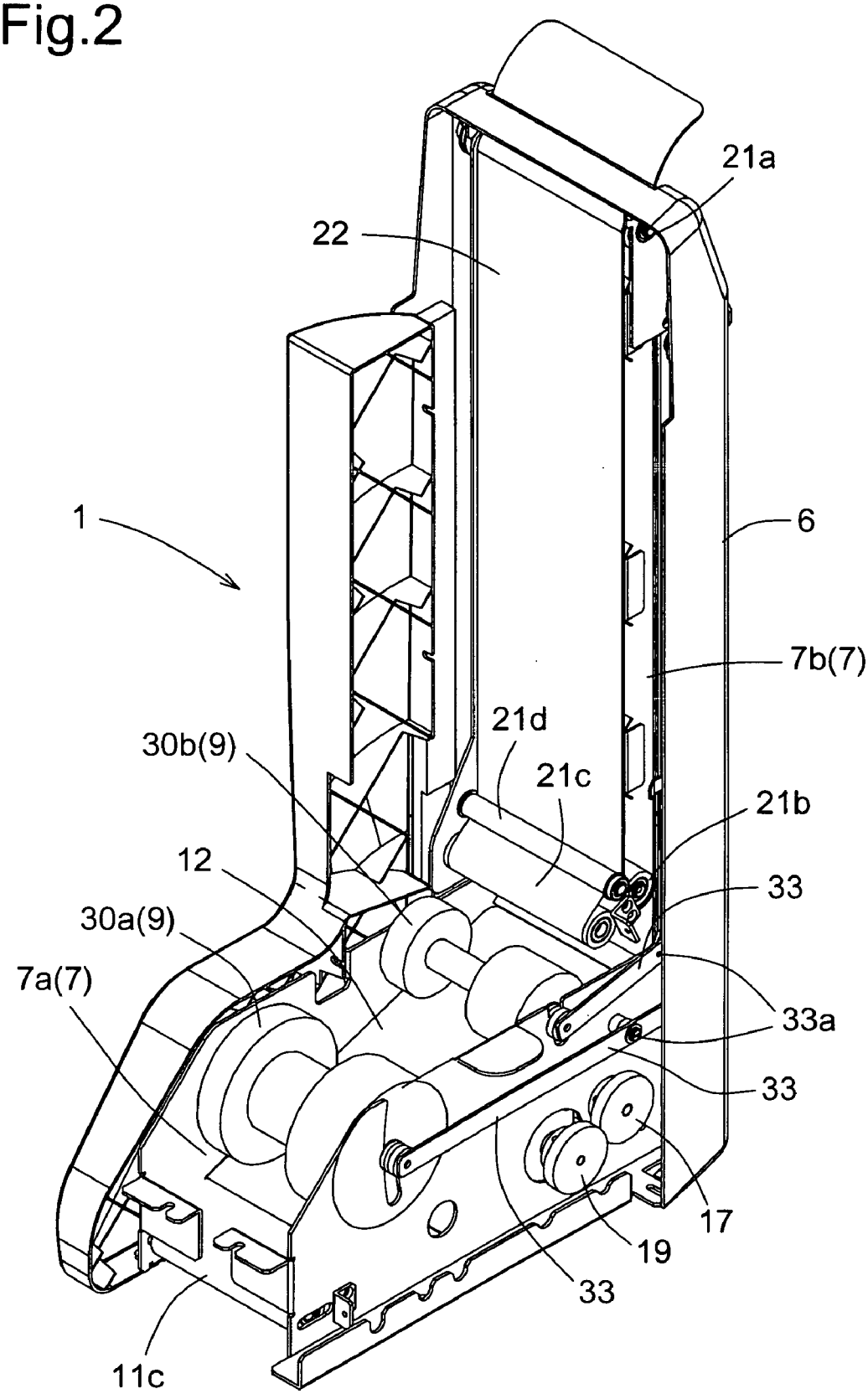
FIG. 2 is a perspective view of a medicine package conveying apparatus as shown in FIG. 1.
Figure 3:
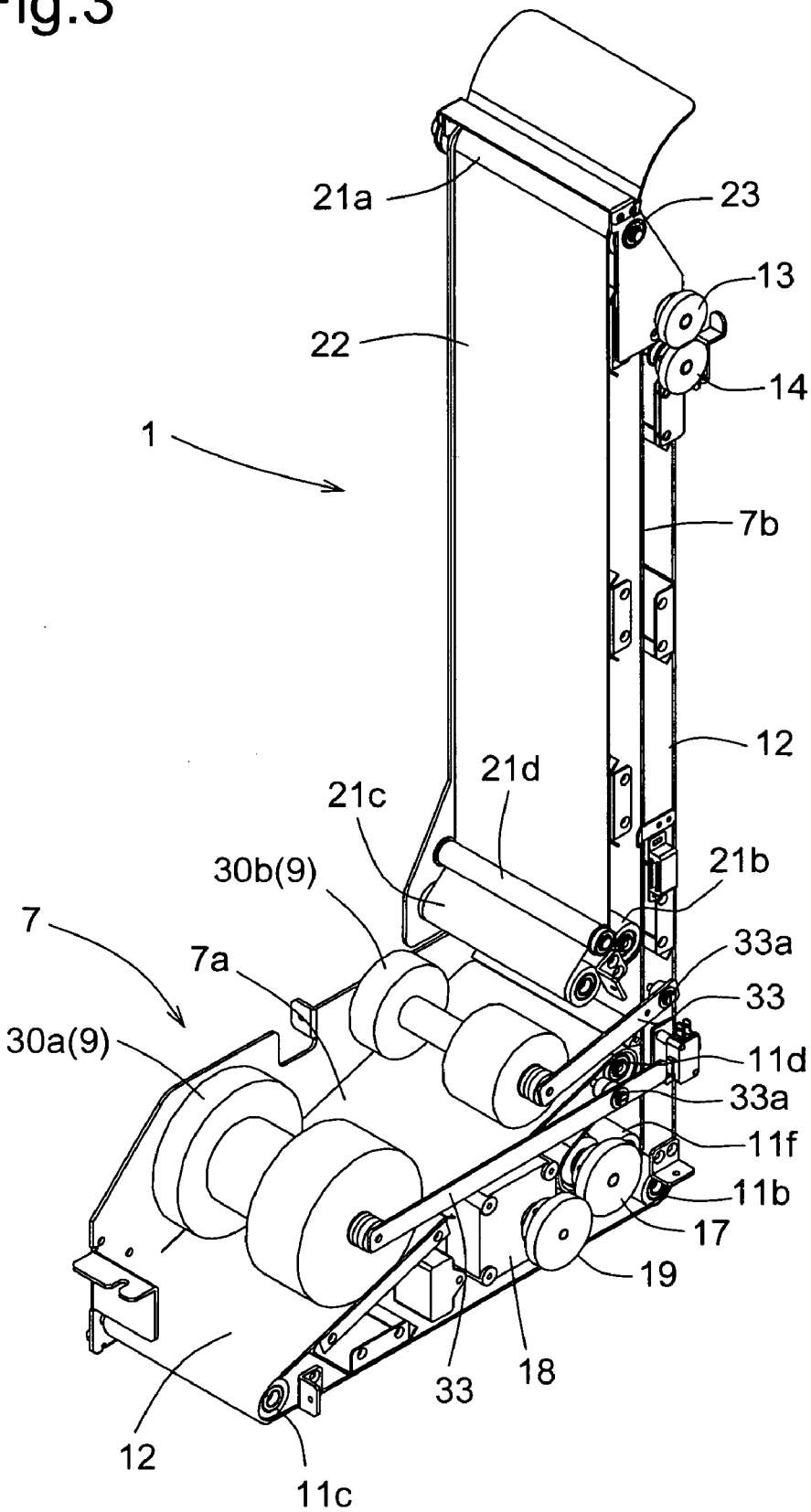
FIG. 3 is a partly broken perspective view of FIG. 2.
Figure 4:
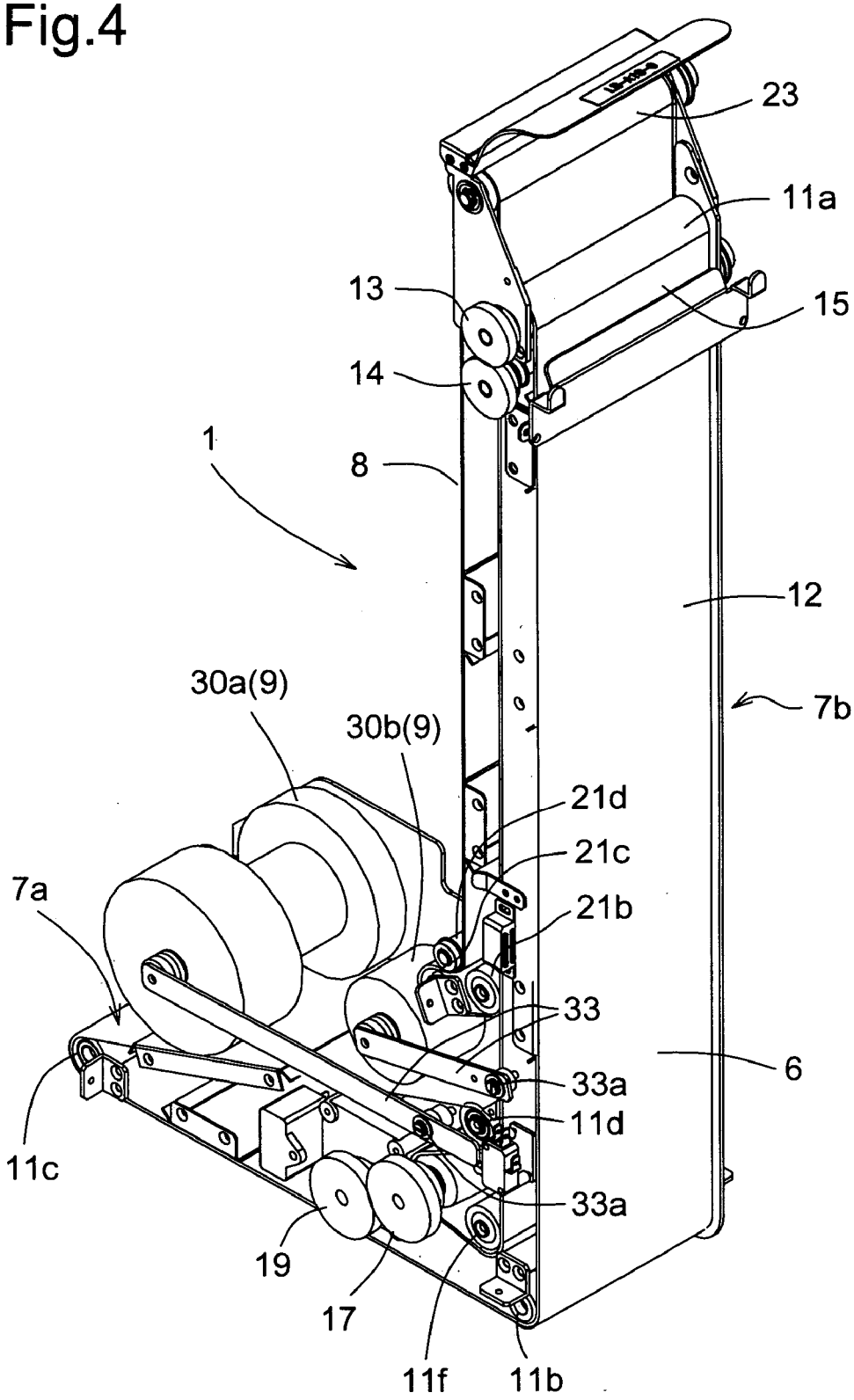
FIG. 4 is a partly broken perspective view viewed from a different direction from FIG. 3.
Figure 9A:
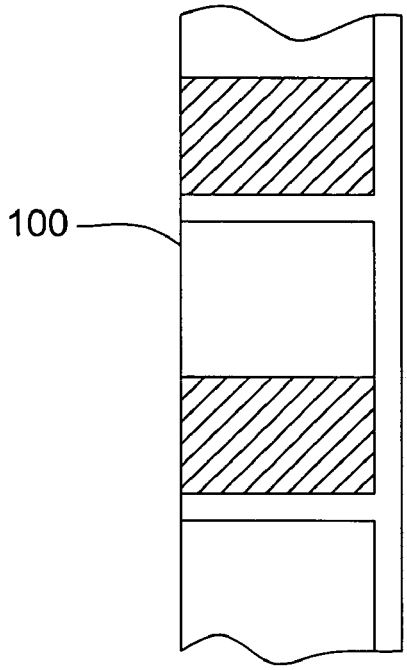
FIG. 9A is a front view of a medicine package.
Figure 9B:
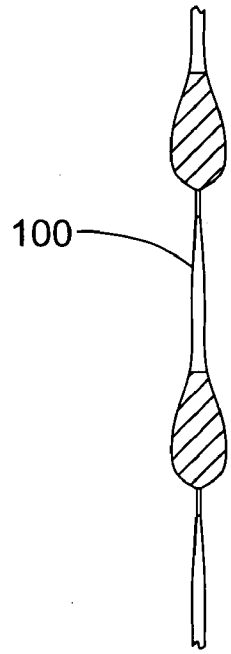
FIG. 9B is a side view of FIG. 9A.

FIG. 1 shows a medicine packing apparatus provided with a medicine package conveying apparatus 1 according to one embodiment of the present invention. In the medicine packing apparatus, medicine (powder, tablets and so on) fed from an R disc or tablet feeders (not shown) are discharged through a hopper 2. Under the hopper 2, a belt-like packing sheet is unwound from a roll 3 and fed in a condition folded into two after medicine name and usage and so on are printed by a printer 4. The packing sheet is sealed by means of a sealing unit 5 each time a dose of medicine is contained in the packing sheet. Thus, as shown in FIG. 9, a medicine package 100 with a plurality of bags, connected like a belt, is formed.

The medicine package conveying apparatus 1, as shown in FIGS. 2 to 5A, comprises a substantially L shaped frame 6, which is provided with a first belt conveyor 7, a second belt conveyor 8, a roller member 9 and so on. Conveyance of the medicine package 100 is controlled by a control unit 10.

Figure 5A:
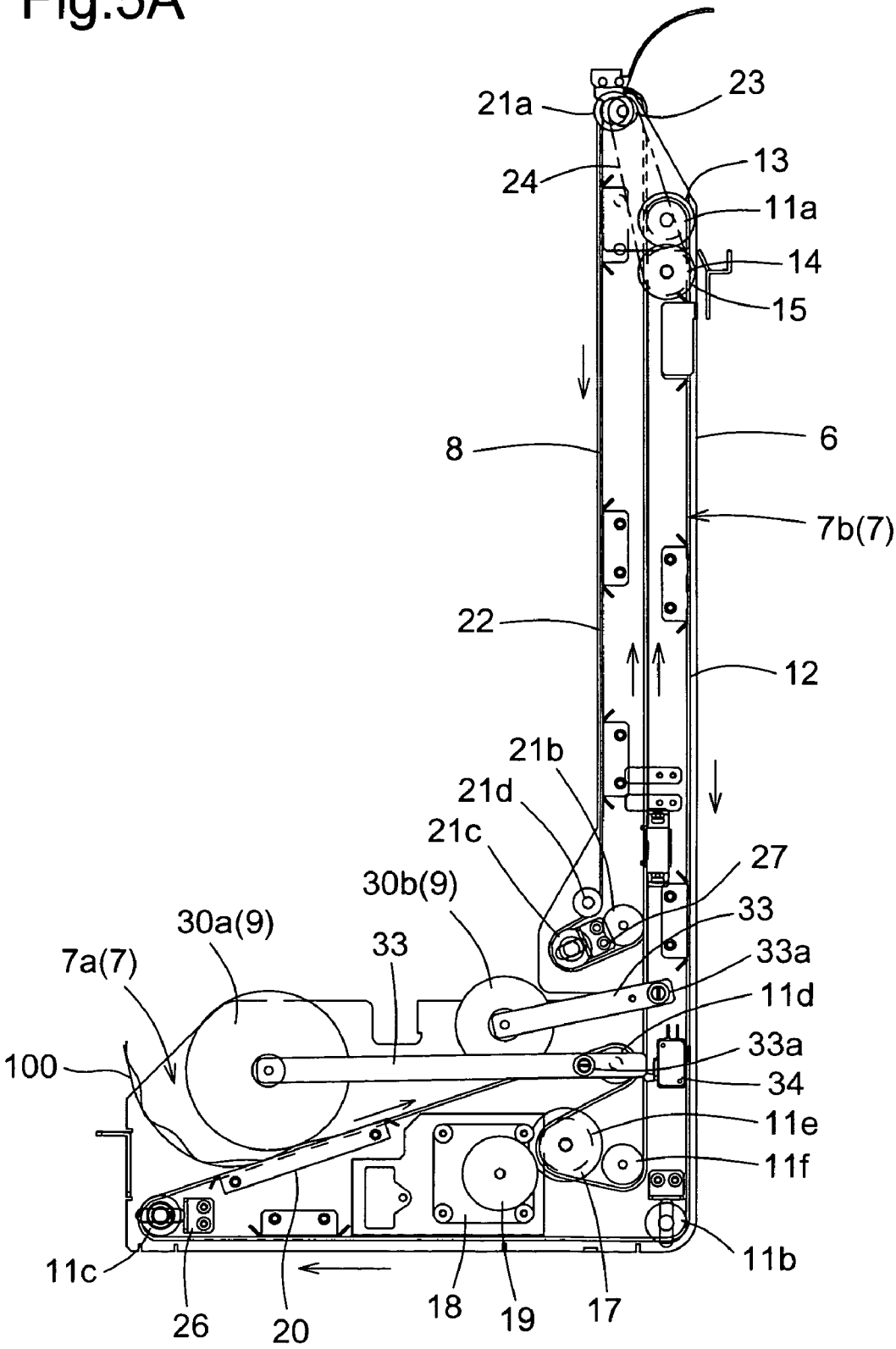
FIG. 5A is a front view of the medicine package conveying apparatus of FIG. 2.

The first belt conveyor 7, as shown in FIG. 5A, comprises a flat belt 12 which runs on a plurality of rollers 11*a*, 11*b*, 11*c*, 11*d*, 11*e* and 11*f*. The first belt conveyor 7 is constituted by a horizontal conveying portion 7*a* and a vertical conveying portion 7*b*. The roller 11*a* positioned at the upper portion of the frame 6*a* is provided with a gear 13. The gear 13 engages with a gear 14 to which a pulley 15 is fixed. The roller 11*e* is provided with a gear 17 which engages with a gear 19 fixed on the rotation shaft of a motor 18. Thus, drive of the motor 18 causes the roller 11*e* to rotate via the gears 19, 17, allowing the flat belt 12 to move in a direction of the arrows. The horizontal conveying portion 7*a* has a portion positioned at an upper side of the flat belt 12 which is gradually inclined toward the vertical conveying portion 7*b* and a lower surface which is guided by a guide plate 20. The roller 11*c* is provided with a tension adjusting portion 26 which makes it possible to move the roller 11*c* in a horizontal direction to adjust a tension acting on the flat belt 12.

The second belt conveyor 8, like the first belt conveyor 7, comprises a flat belt 22 which runs on a plurality of rollers 21*a*, 21*b*, 21*c* and 21*d*. The second belt conveyor 8 is pivotably mounted on the frame 6 around the roller 21*a* so that the second belt conveyor 8 can contact with and depart from the first belt conveyor 7. To the roller 21*a* is fixed a pulley 23. A drive power of the motor 18 is transmitted via a belt 24 supported between the pulley 23 and the pulley 15 of the first belt conveyor 7. This allows the second belt conveyor 8 to move in synchronization with the first belt conveyor 7, causing the opposite flat belts 12, 22 to move from downward to upward together. The pivot position of the second belt conveyor 8 is detected by means of a pivot position detecting sensor (not shown) comprising a beam sensor and so on. In this embodiment, when the second belt conveyor 8 pivots by more than a constant angle from a vertical position, a detection signal of the pivot position detecting sensor is switched from ON to OFF. The roller 21*c* is provided with a tension adjusting portion 27 similar to the first belt conveyor 7.

The roller member 9 comprises a first roller 30*a* and a second roller 30*b*. Both rollers 30*a*, 30*b* are made of elastic material for example sponge and formed so that the external diameter is small except both end portions. The large diameter portions of both ends constitute press portions 31 while the central narrow portion of small diameter constitutes an escape portion 32. Each roller 30*a*, 30*b* is rotatably attached on one end of the arm 33. The other end of the arm 33 is supported on the frame 6 rotatably around a support shaft 33*a*. Thus, the roller member 9 presses the press portions 31 toward the first belt conveyor 7 by it's own weight so that the medicine package 100 is sandwiched between the press portions 31 and the flat belt 12. When the first belt conveyor 7 is driven, the roller member 9 rotates as the flat belt 12 moves, making the conveying state of the medicine package 100 stable. If a capsule is contained in the medicine package 100 in a standing state (FIG. 10) or a position where powder is contained in the medicine package 100 is biased, the thickness of the medicine package 100 becomes larger than expected. However, the thick portion of the medicine package 100 is positioned at the escape portion 32 of the roller member 9, thereby eliminating interference with the roller member 9. In the event that clogging of the medicine package 100 is caused, if a force of more than standard value is exerted on the roller member 9, the roller member 9 moves around the support shaft 33*a* via the arm 33, which does not apply an excessive load to the medicine package 100. A pivoting position of the arm 33, i.e. each roller 30*a*, 30*b* is detected by means of the pivot position detecting sensor 34 comprising a beam sensor and so on. In this embodiment, when the arm 33 of the roller member 9 pivots by more than a constant angle from a horizontal position, a detection signal of the pivot position detecting sensor 34 is switched from ON to OFF. The detection signal is utilized for a drive control of the first belt conveyor 7.

The control unit 10 controls energization to the motor 18 based on the detection signal of the pivot position detecting sensor.

Hereinafter, operation of the medicine package conveying apparatus 1 will be described.

After a medicine is packed by one dose in accordance with a prescription data, a medicine package 100 is discharged to the medicine package conveying apparatus 1. The discharged medicine package 100 meets the horizontal conveying portion 7*a* of the first belt conveyor 7 and is conveyed in an approximately horizontal direction, i.e. in an obliquely upward direction for detail in a state in which the medicine package 100 is sandwiched between the flat belt 12 and the first roller member 30*a* followed by the second roller member 30*b* as the flat belt 12 driven by the motor 18 moves. Then the medicine package 100 is introduced between the first belt conveyor 7 and the second belt conveyor 8 where the conveying direction is converted to upward, and then discharged from the upper end of the conveyors 7, 8. During this time, the medicine package 100 moves in a space surrounded by the frame 6 and both of the belt conveyors 7, 8, thereby preventing adhesion of dust and so on.

Figure 10:
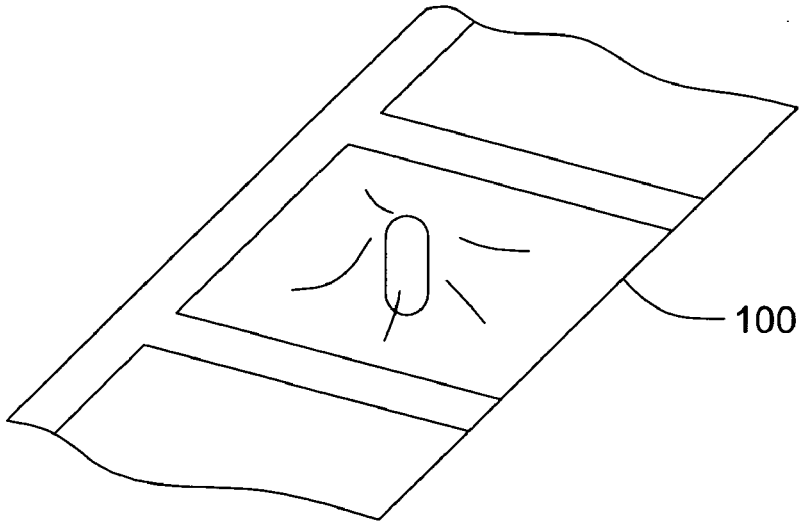
FIG. 10 is a perspective view of another example of a medicine package.

By the way, as the size and quantity of the medicine contained in the medicine package 100 are varied, the bulge state of each medicine package 100 is different. When the medicine package 100 is conveyed in a vertical direction by the medicine package conveying apparatus 1, the medicine contained in the medicine package 100 is located on the downward side as shown in FIG. 9(*b*), thereby enlarging the partial bulk of the medicine package 100. In the case where the medicine is a capsule, if the capsule is contained in a state that the capsule is standing in a direction of thickness of the medicine package 100 as shown in FIG. 10, the bulk or bulged part of the central portion of the medicine package 100 becomes large. In this case, according to the roller member 9, the bulk portion of the medicine package 100 is positioned at the escape portion 32, thereby eliminating interference with the roller member 9. Especially, even in the medicine package 100 comprising only two dose packages or the medicine package 100 having a long length, there is a tendency that the medicine package 100 can not be conveyed due to clogging and so on when the front end thereof passes through. However, according to the above construction, the medicine package 100 can be smoothly conveyed. In the event that clogging of the medicine package 100 is caused, the roller members 9 pivot around the support shafts 33*a* via the arms 33, eliminating interference with the roller member 9. Therefore, any excessive load is not applied to the medicine package 100, thereby preventing the medicine package 100 from tearing.

In addition, the speed of the medicine package 100 fed to the medicine package conveying apparatus 1 varies based on the difference of kind or quantity of the medicine to be prescribed. On the other hand, the speed of the medicine package 100 conveyed by the medicine package conveying apparatus 1 is constant. Therefore, when the feed speed of the medicine package 100 is smaller than the conveying speed by the medicine package conveying apparatus 1, a tension force is exerted on the medicine package 100. In this case, when the roller member 9 is pivoted as shown in FIG. 513 and the pivot position is detected by the pivot position detecting sensor 34 (an OFF signal is outputted), the motor 18 is forcedly stopped. Thus, the tension force exerted on the medicine package 100 is relieved, preventing the medicine package 100 from becoming damaged. Moreover, the pivot position detecting sensor 34 outputs an OFF signal only when the roller members 9 are over-pivoted. Thus, even if the output signal becomes an OFF state due to failure, the motor 18 is stopped, preventing malfunction.

Figure 7:
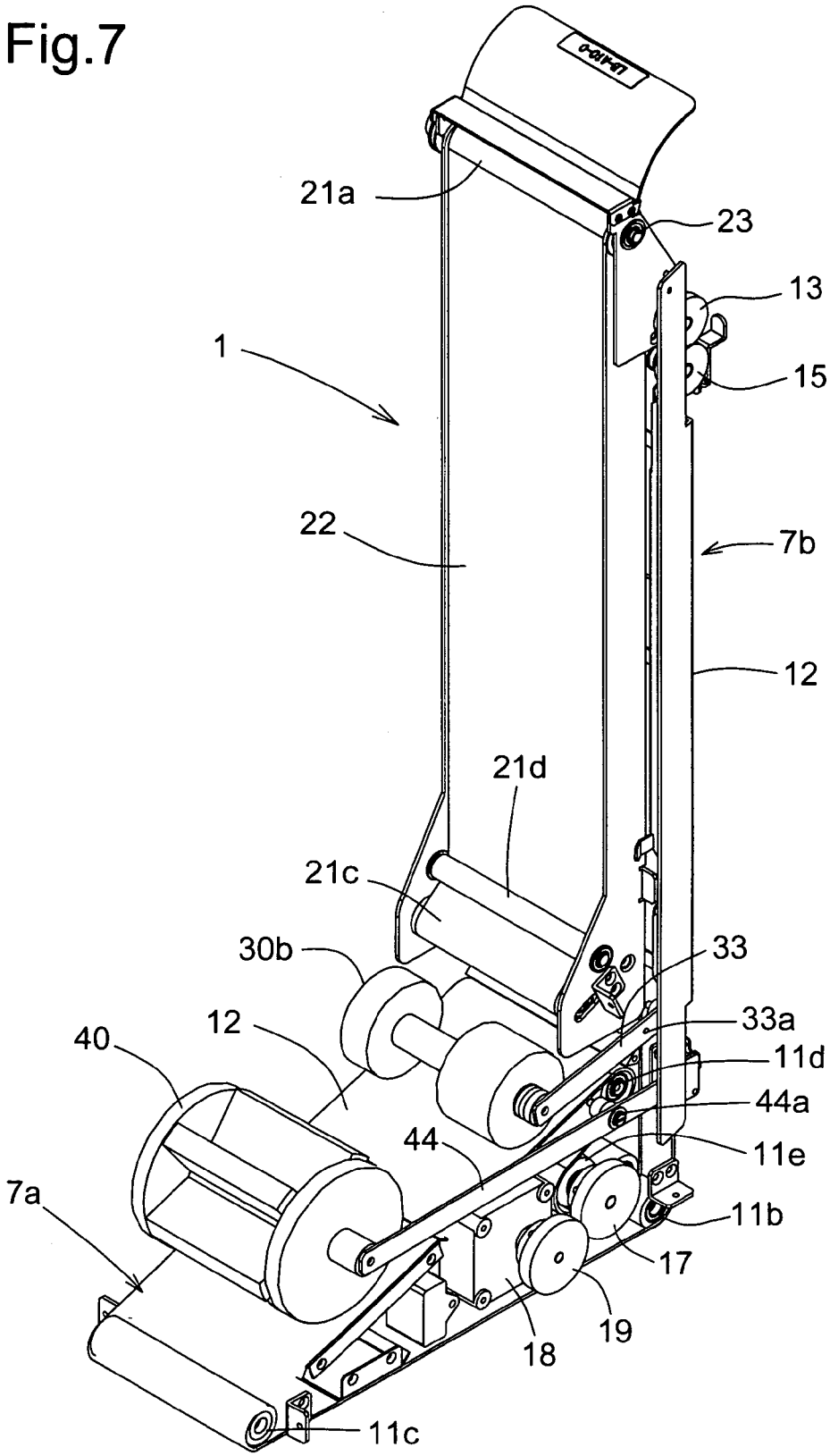
FIG. 7 is a perspective view of a medicine package conveying apparatus according to an another embodiment.
Figure 8:
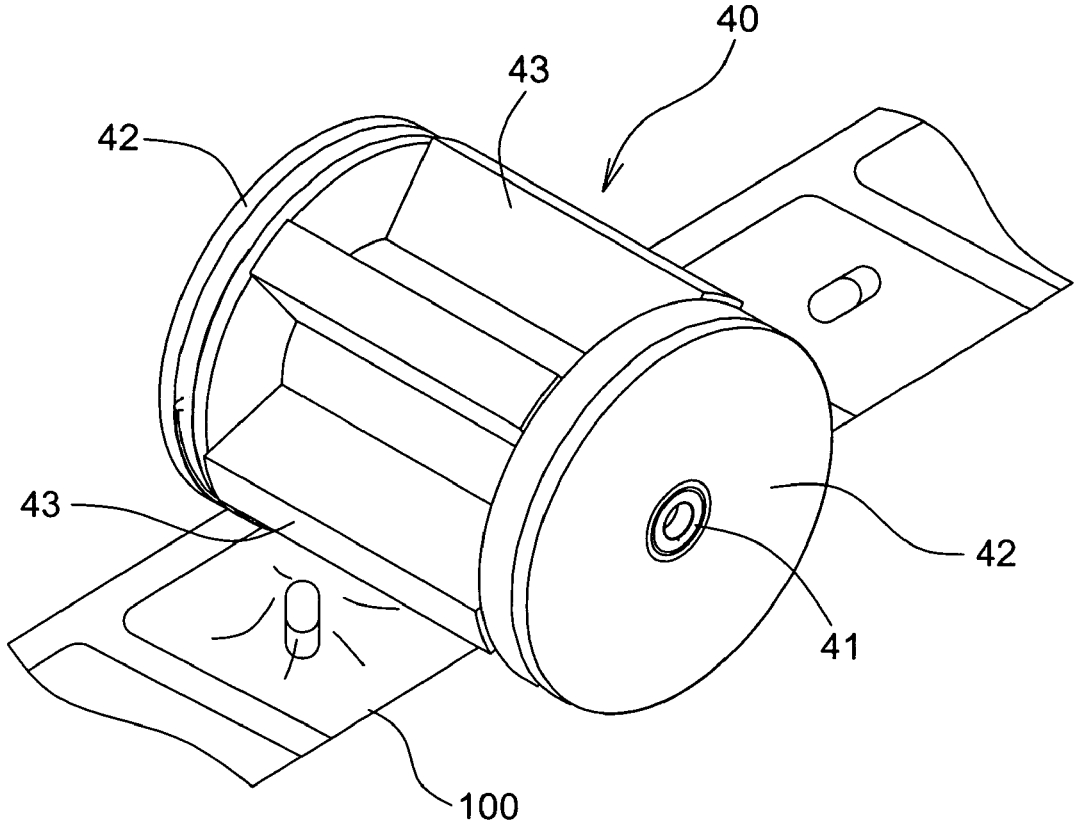
FIG. 8 is a perspective view of a roller member used in the medicine package conveying apparatus of FIG. 7.

Although the roller member 9 has a construction comprising the press portion 31 and the escape portion 32, it may be constructed as shown in FIGS. 7 and 8.

That is, in FIGS. 7 and 8, a roller member 40 is formed with guide portions 42 of disc-like shape on both end portions of a rotation shaft 41. Between the guide portions 42, five fin portions 43 protrude from the outer surface of the rotation shaft 41 with a constant pitch. The fin portions 43 are so constructed that the medicine package 100 can be sandwiched between at least one of them and the first belt conveyor 7. The roller member 40 is rotatably attached on one end of an arm 44 in the same manner as the above roller member 9. The arm 44 is supported on the frame 6 pivotably around a support shaft 44*a*. In the embodiment shown in FIG. 8, the guide portions 42 are made of rubber and the fin portions 43 are made of sponge.

According to the roller member 40 having the above construction, when the first belt conveyor 7 is driven, the medicine package 100 is conveyed in a state in which the medicine package 100 is sandwiched between the flat belt 12 and at least one of the fin portions 43 of the roller member 40. The guide portions 42 come into contact with the flat belt 12, preventing unnecessary deformation of the fin portions 43 in a state in which the fin portions 43 do not interfere with the bulge portion of the medicine package 100. In the case in which the bulge portion, as described above, is caused while conveying the medicine package 100, the fin portions 43 become elastically deformed, which never prevents the medicine package 100 from being conveyed. If the bulge of the medicine package 100 is caused by erection of the capsule, the fin portions 43 exert a force on the capsule causing the capsule to lay down, and thereby facilitating conveying and folding of the medicine package 100 thereafter.

In the aforementioned embodiment, the roller members 9, 40 are constituted so as to pivot via the arms 33, 44, though it is also possible to make the arms 33, 44 fixed types.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A medicine package conveying apparatus, comprising:

a conveyor for conveying a medicine package with a plurality of bags in which medicine is packaged, the conveyor comprising a flat belt; and a roller member made of elastic material, the roller member comprising press portions of cylindrical shape for rotating and pressing both side edges of the medicine package on the conveyor and an escape portion which is positioned between the press portions and is smaller in a diameter than the press portions, the escape portion being arranged so as to face the flat belt of the conveyor.

2. The apparatus as in claim 1, wherein the escape portion is formed so as not to interfere with the medicine package to be conveyed.

3. The apparatus as in claim 1, wherein the roller member capable of pivoting so that the roller member can be released from the conveyor when the press portions are pushed up by a force of more than a determined value.

4. A medicine package conveying apparatus, comprising:

a conveyor for conveying a medicine package with a plurality of bags in which medicine is packaged; and a roller member comprising a plurality of fin portions having an elasticity, the plurality of fin portions radially extending from a rotation shaft of the roller member so that at least one of the plurality of fin portions presses the medicine package on the conveyor.

5. The apparatus as in claim 4, wherein the roller member further comprises guide portions of cylindrical shape, the guide portions being positioned on opposite sides of the rotation shaft so as to contact the conveyor to prevent the fin portions from deforming.

6. The apparatus as in claim 4, wherein the plurality of fin portions are positioned with such a pitch that when a medicine capsule is contained in the medicine package in a state of standing in a direction of thickness of the medicine package, the capsule can be laid down.

* * * * *

UNITED STATES PATENT AND TRADEMARK OFFICE

CERTIFICATE OF CORRECTION

PATENT NO. : 7,121,397 B2
APPLICATION NO. : 10/990422
DATED : October 16, 2006
INVENTOR(S) : Shoji Yuyama et al.

It is certified that error appears in the above-identified patent and that said Letters Patent is hereby corrected as shown below:

In column 1, line 9, please replace “fiat belts” with --flat belts--.

In column 3, line 20, please replace “in portions” with --fin portions--.

In column 4, line 46, please replace “material for example” with --material, for example--.

Figure 5B:
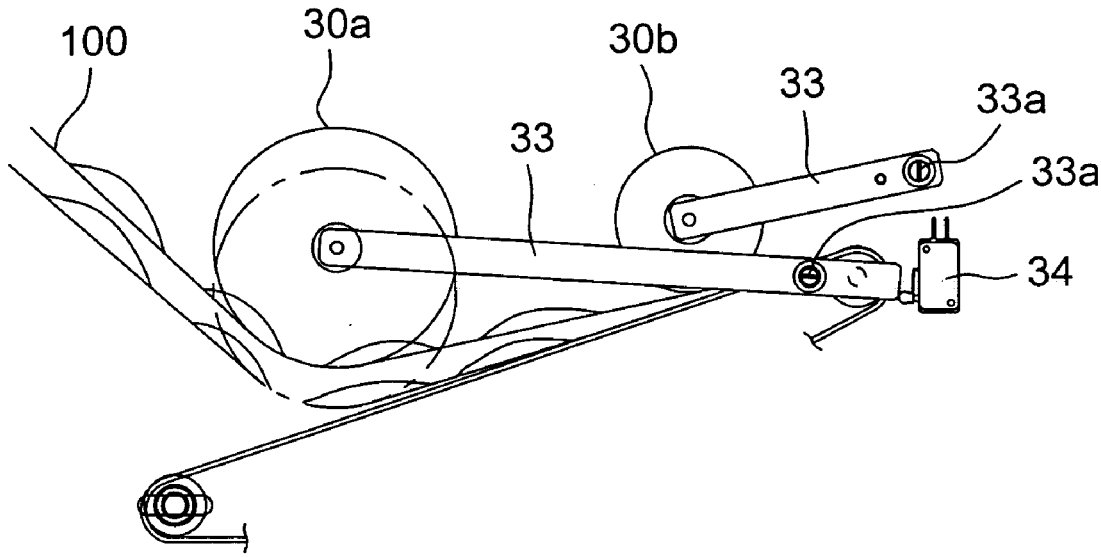
FIG. 5B is a front view of the roller member showing a pivoted state.
Figure 6:
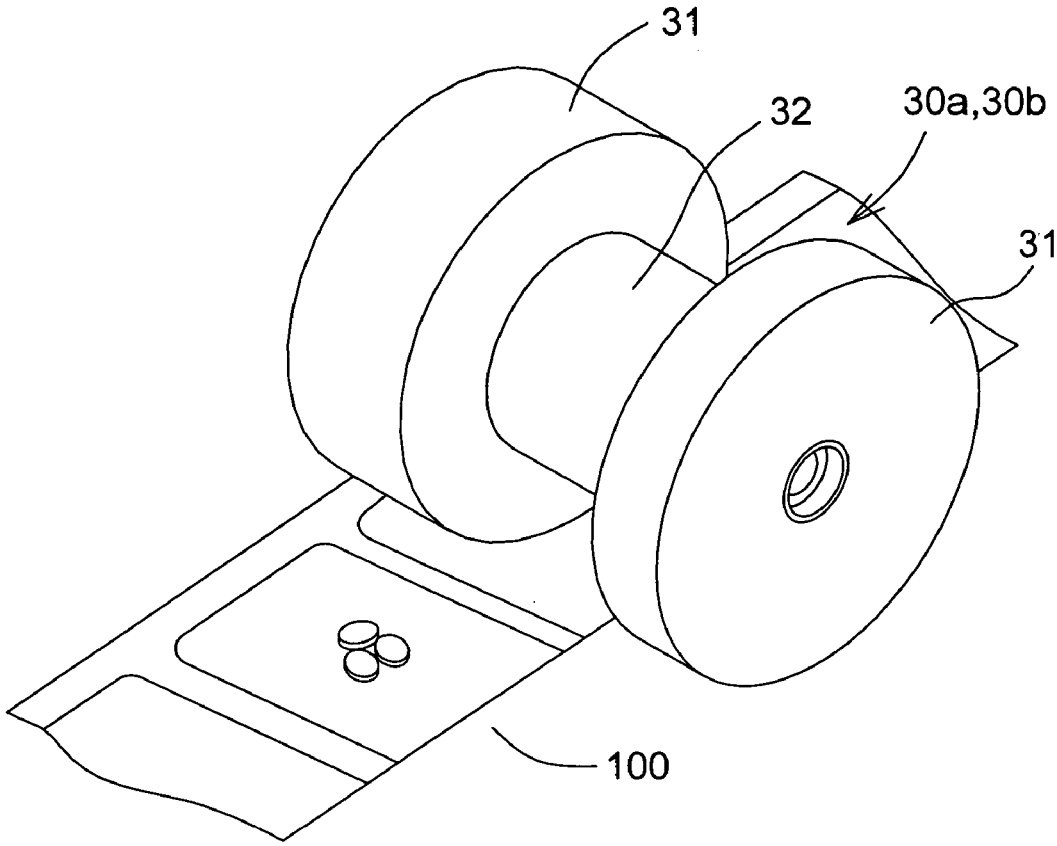
FIG. 6 is a perspective view of a roller member used in the medicine package conveying apparatus of FIG. 2.

In column 6, lines 6-7, please replace “FIG. 513” with --FIG. 5B--.

In column 7, please replace “a determined value” with --a predetermined value--.

Signed and Sealed this

Second Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,121,397 B2
APPLICATION NO. : 10/990422
DATED : October 17, 2006
INVENTOR(S) : Shoji Yuyama et al.

It is certified that error appears in the above-identified patent and that said Letters Patent is hereby corrected as shown below:

In column 1, line 9, please replace “fiat belts” with --flat belts--.

In column 3, line 20, please replace “in portions” with --fin portions--.

In column 4, line 46, please replace “material for example” with --material, for example--.

In column 6, lines 6-7, please replace “FIG. 513” with --FIG. 5B--.

In column 7, please replace “a determined value” with --a predetermined value--.

This certificate supersedes Certificate of Correction issued January 2, 2007.

Signed and Sealed this

Sixth Day of February, 2007

JON W. DUDAS
*Director of the United States Patent and Trademark Office*